US008764877B2

(12) United States Patent
Sato et al.

(10) Patent No.: US 8,764,877 B2
(45) Date of Patent: Jul. 1, 2014

(54) METHOD FOR PRODUCING HIGH-PURITY TUNGSTEN POWDER

(75) Inventors: Jin Sato, Ibaraki (JP); Kouichi Takemoto, Ibaraki (JP); Takeshi Sasaki, Osaka (JP); Mikio Ohno, Osaka (JP); Junji Ogura, Osaka (JP)

(73) Assignees: JX Nippon Mining & Metals Corporation, Tokyo (JP); Japan New Metals Co., Ltd., Osaka (JP)

( * ) Notice: Subject to any disclaimer, the term of this patent is extended or adjusted under 35 U.S.C. 154(b) by 235 days.

(21) Appl. No.: 13/498,252

(22) PCT Filed: Sep. 28, 2010

(86) PCT No.: PCT/JP2010/066810

§ 371 (c)(1),
(2), (4) Date: Mar. 26, 2012

(87) PCT Pub. No.: WO2011/040400

PCT Pub. Date: Apr. 7, 2011

(65) Prior Publication Data

US 2012/0180600 A1 Jul. 19, 2012

(30) Foreign Application Priority Data

Oct. 1, 2009 (JP) ..... 2009-229570

(51) Int. Cl.
*B22F 9/26* (2006.01)
*B22F 9/22* (2006.01)
*C22C 27/04* (2006.01)

(52) U.S. Cl.
CPC ..... *B22F 9/22* (2013.01); *B22F 2201/013* (2013.01); *C22C 27/04* (2013.01)
USPC ..... 75/370; 75/717

(58) Field of Classification Search
None
See application file for complete search history.

(56) References Cited

U.S. PATENT DOCUMENTS

| | | | | |
|---|---|---|---|---|
| 3,850,614 | A * | 11/1974 | Bleecker | 75/351 |
| 5,632,824 | A * | 5/1997 | Grenthe et al. | 148/237 |
| 2003/0121365 | A1* | 7/2003 | Dover et al. | 75/369 |
| 2007/0172378 | A1 | 7/2007 | Shibuya et al. | |
| 2008/0223175 | A1* | 9/2008 | Lunk et al. | 75/369 |
| 2010/0028250 | A1 | 2/2010 | Stoller et al. | |
| 2010/0098619 | A1 | 4/2010 | Stoller et al. | |

FOREIGN PATENT DOCUMENTS

| | | | |
|---|---|---|---|
| JP | 61-107728 | A | 5/1986 |
| JP | 62-108731 | A | 5/1987 |
| JP | 01-172226 | A | 7/1989 |
| JP | 03-150356 | A | 6/1991 |
| JP | 06-158300 | A | 6/1994 |
| JP | 2005-307235 | A | 11/2005 |

* cited by examiner

*Primary Examiner* — George Wyszomierski
(74) *Attorney, Agent, or Firm* — Howson & Howson LLP

(57) ABSTRACT

Provided is a method for producing a high-purity tungsten powder having a phosphorus content of less than 1 wtppm; wherein an ammonium tungstate solution containing 1 wtppm or more of phosphorus as an impurity in terms of the inclusion in tungsten is used as a starting material, this solution is neutralized with hydrochloric acid at a temperature of 50° C. or less to adjust the pH at 4 or more and less than 7 so as to precipitate ammonium paratungstate undecahydrate crystals, the resulting solution is heated to 70 to 90° C. and filtered in a high-temperature state so as to obtain ammonium paratungstate pentahydrate crystals, the obtained crystals are calcined so as to form a tungsten oxide, and the tungsten oxide is subject to hydrogen reduction so as to obtain a high-purity tungsten powder. Additionally provided is a method for producing a high-purity tungsten powder having a phosphorus content of 0.4 wtppm or less; wherein the ammonium tungstate solution is neutralized with hydrochloric acid to adjust the pH at 4 or more and 6 or less, and this solution is subject to the same procedure as described above so as to obtain a high-purity tungsten powder. Consequently, the phosphorus content can be efficiently reduced.

4 Claims, No Drawings

METHOD FOR PRODUCING HIGH-PURITY TUNGSTEN POWDER

TECHNICAL FIELD

Generally speaking, the deposition method by sputtering a sintered tungsten target is often used upon forming a gate electrode or a wiring material for an IC, LSI or the like, and the present invention relates to a method of producing a high-purity tungsten powder which is particularly effective upon producing the foregoing sintered tungsten target.

BACKGROUND ART

In recent years, pursuant to the higher integration of very-large-scale integrated circuits (VLSI), studies are being conducted for using materials having lower electrical resistivity as the electrode material or the wiring material. Under the foregoing circumstances, high-purity tungsten having low resistivity and thermal and chemical stability is being used as the electrode material or the wiring material.

The foregoing electrode material or wiring material for VLSI is generally produced by way of the sputtering method or the CVD method, but the sputtering method is being widely used in comparison to the CVD method since the structure and operation of the sputtering device are relatively simple, deposition can be performed easily, and the process is of low cost.

Nevertheless, a tungsten target that is used for the deposition of the electrode material or wiring material for VLSI in the sputtering method is required to be of a relatively large size of ϕ 300 mm or larger, and to have high purity and high density.

Conventionally, as methods of preparing this kind of large-size tungsten target, the following methods are known; namely, a method of preparing an ingot by way of electron beam melting and subjecting the obtained ingot to hot rolling (Patent Document 1), a method of subjecting tungsten powder to pressure sintering and thereafter to rolling (Patent Document 2), and a so called CVD-W method of laminating a tungsten layer on the entire surface of a tungsten bottom plate by way of the CVD method (Patent Document 3).

Nevertheless, with the method of rolling the ingot obtained based on electron beam melting or the sintered compact obtained by subjecting tungsten powder to pressure sintering, there are problems in that the target is mechanically fragile since the crystal grains easily coarsen, and granular defects referred to as particles are easily generated on the sputtered film. Moreover, although the CVD-W method yields favorable sputtering characteristics, there is a problem in that it is extremely time-consuming and expensive to prepare the target.

In addition, disclosed is technology of using tungsten powder containing 2 to 20 ppm of phosphorus (P) as the raw material, and sintering this raw material by way of hot pressing and HIP in order to produce a tungsten target having an average grain size of ϕ 40 μm or less (refer to Patent Document 4).

In the foregoing case, the requirement is the inclusion of phosphorus in an amount of 2 ppm or more, but the inclusion of phosphorus caused a problem of deteriorating the grain boundary intensity of the sintered compact. In particular, if it is a large-size tungsten target and large amounts of phosphorus are contained therein, abnormal grain growth tends to occur locally, and grains of approximately 500 μm to 2 mm will be scattered about. Crystals that were subject to the foregoing abnormal grain growth will further deteriorate the grain boundary intensity, and there is a problem in that chipping will occur during the machining process for grinding the target and the product yield will deteriorate.

Although it is possible to devise the sintering conditions for resolving the problem of the abnormal grain growth of tungsten, there is a problem in that this merely results in a more complex production process and does not offer a solution for stable production.

In addition, disclosed is technology of acquiring a high-purity tungsten target having a purity level of 3N5 to 7N and an average grain size of 30 μm (refer to Patent Document 5). Nevertheless, in the foregoing case, the total impurity content and the impurities which are undesirable in semiconductors (Fe, Cr, Ni, Na, K, U, Th, etc.) are merely prescribed, and there is no disclosure regarding the problems caused by the inclusion of phosphorus.

Accordingly, this technology has numerous problems; specifically, occurrence of defective targets, deterioration of yield in the target production process, increase in production costs, and so on.

Under the foregoing circumstances, Patent Document 6 developed by the present Applicant ("Nippon Mining Co." as the Applicant prior to the name change) is the most effective method for producing a high-purity tungsten powder. For example, ammonium metatungstate is dissolved in water to create a tungsten-containing aqueous solution; inorganic acid is added to the tungsten-containing aqueous solution; the solution is heated to precipitate tungstate crystals; after performing solid-liquid separation, the tungstate crystals are dissolved in ammonia water to create a purified mother water for ammonium paratungstate crystal precipitation and an undissolved residue containing impurities such as iron; the undissolved residue is subject to separation cleaning; the purified mother water for ammonium paratungstate crystal precipitation is heated; and inorganic acid is added to adjust the pH for precipitating the ammonium paratungstate crystals; whereby high purity ammonium paratungstate crystals are produced.

The ammonium paratungstate crystals obtained with the foregoing method are further calcined to form a tungsten oxide, and hydrogen reduction is additionally performed at high temperature in order to obtain a high-purity tungsten powder. In many respects, Patent Document 6 is the fundamental technology upon producing a high-purity tungsten powder, but it was necessary to make additional improvements for further reducing the phosphorus content under the present conditions where the reduction of the phosphorus content are strongly required.

[Patent Document 1] Japanese Laid-Open Patent Publication No. S61-107728
[Patent Document 2] Japanese Laid-Open Patent Publication No. H3-150356
[Patent Document 3] Japanese Laid-Open Patent Publication No. H6-158300
[Patent Document 4] Japanese Laid-Open Patent Publication No. 2005-307235
[Patent Document 5] WO2005/73418
[Patent Document 6] Japanese Laid-Open Patent Publication No. H1-172226

SUMMARY OF INVENTION

Problems to be Solved by the Invention

It has been discovered that the inclusion of phosphorus heavily affects the abnormal grain growth of tungsten and the deterioration in the target strength. In particular, if phosphorus is contained in an amount exceeding 1 ppm, crystal grains subject to abnormal grain growth will exist in the tungsten target, and grains of approximately 500 μm or more will be scattered about. Moreover, it has also been discovered that crystals that were subject to the foregoing abnormal grain growth further deteriorate the target strength.

Thus, an object of this invention is to prevent the abnormal grain growth of tungsten and improve the product yield of the target by being so aware of the phosphorus contained in the tungsten as a harmful impurity and developing a production method capable of reducing the phosphorus content as much as possible so that it will be less than 1 ppm.

Moreover, if it is possible to reduce the phosphorus content and develop highly purified tungsten, it goes without saying that this invention can be applied to other usages, in which the phosphorus contained in the tungsten is recognized as an impurity, in addition to the use for producing a target. The present invention aims to obtain a method for producing a high-purity tungsten powder that can be applied to the foregoing usages. In order to facilitate the understanding of this invention, the advantages and disadvantages upon using the high-purity tungsten produced according to the present invention mainly for producing a target will be described below.

Means for Solving the Invention

In order to achieve the foregoing object, the present inventors provide the following invention:

1) A method for producing a high-purity tungsten powder having a phosphorus content of less than 1 wtppm; wherein an ammonium tungstate solution containing 1 wtppm or more of phosphorus as an impurity in terms of the inclusion in tungsten is used as a starting material, this solution is neutralized with hydrochloric acid at a temperature of 50° C. or less to adjust the pH at 4 or more and less than 7 so as to precipitate ammonium paratungstate undecahydrate crystals, the resulting solution is heated to 70 to 90° C. and filtered in a high-temperature state so as to obtain ammonium paratungstate pentahydrate crystals, the obtained crystals are calcined so as to form a tungsten oxide, and the tungsten oxide is subject to hydrogen reduction so as to obtain a high-purity tungsten powder; and 2) A method for producing a high-purity tungsten powder having a phosphorus content of 0.7 wtppm or less; wherein the ammonium tungstate solution is neutralized with hydrochloric acid to preferably adjust the pH at 4 or more and 6 or less so as to precipitate ammonium paratungstate undecahydrate crystals, the resulting solution is heated to 70 to 90° C. and filtered in a high-temperature state so as to obtain ammonium paratungstate pentahydrate crystals, the obtained crystals are calcined so as to form a tungsten oxide, and the tungsten oxide is subject to hydrogen reduction so as to obtain a high-purity tungsten powder.

Effect of Invention

As a result of reducing the foregoing phosphorus content to be less than 1 wtppm, preferably 0.7 wtppm or less, and more preferably 0.4 wtppm or less, the abnormal grain growth of tungsten can be effectively inhibited. When the high-purity tungsten powder produced as described above is used, for example, for manufacturing a target of sintered compact; it becomes possible to prevent the deterioration in the target strength and resolve, at once, the numerous problems encountered in a sintered tungsten target; specifically, occurrence of defective targets, deterioration of yield in the target production process, increase in production costs, and so on. The present invention additionally yields a superior effect of being able to improve the uniformity of the tungsten wiring film.

DESCRIPTION OF EMBODIMENTS

In the method for producing a high-purity tungsten powder of the present invention, an ammonium tungstate solution is used as the starting material. As the starting material in the foregoing case, either an ammonium metatungstate solution or an ammonium paratungstate solution can be used, but under normal circumstances, ammonium paratungstate contains in excess of 1.6 wtppm of phosphorus as an impurity, and in excess of 2.3 wtppm as a content assuming the phosphorus is in tungsten metal. In addition, the foregoing solution is neutralized with hydrochloric acid to adjust the pH at 4 or more and less than 7 so that ammonium paratungstate undecahydrate crystals are precipitated. Note that the neutralization temperature in the foregoing case is set to 50° C. or less. If the temperature becomes high, the pentahydration of the undecahydrate will advance and have an adverse impact on the effect of reducing phosphorus, the hydrochloric acid will become volatilized and contaminate the environment, and the yield will deteriorate. Thus, it is desirable to set the temperature to 50° C. or less. In Patent Document 6 described above, a pH is set at 6 or more and 8 or less while heating to 80 to 95° C., and this is clearly different from the present invention. Moreover, Patent Document 6 aims to reduce the impurities of Na, K, Fe, and U, and the object thereof is also different.

By way of reference, the purity of the commercially available ammonium paratungstate to be used as the starting material is shown in Table 1. Here, 1.69 wtppm of phosphorus was contained. The analytical values other than the purity shown in Table 1 were obtained by additionally measuring Mg, Ca, Cu, Zn, Zr, Hf, Ta, Pb, Th, and U, but these were all below the minimum limit of determination.

Moreover, upon using an ammonium metatungstate solution, the phosphorus can be reduced according to the same procedure.

For example, there is a method in which: ammonium metatungstate is dissolved in water to create a tungsten-containing aqueous solution; inorganic acid is added to the tungsten-containing aqueous solution; the solution is heated to deposit tungstate crystals; after performing solid-liquid separation, the tungstate crystals are dissolved in ammonia water to create a purified mother water for ammonium paratungstate crystal precipitation and an undissolved residue containing impurities such as iron; the undissolved residue is subject to separation cleaning; and the purified mother water for ammonium paratungstate crystal precipitation is neutralized with hydrochloric acid at 50° C. or less to adjust the pH at 4 or more and less than 7; whereby ammonium paratungstate undecahydrate crystals are precipitated. This method can be applied to reduce the phosphorus.

TABLE 1

| Element | Commercially Available Refined APT |
|---|---|
| Na | 0.77 |
| Al | 0.07 |
| Si | 0.32 |
| P | 1.69 |
| S | 4.16 |
| Cl | 5.07 |

TABLE 1-continued

| Element | Commercially Available Refined APT |
|---|---|
| K | <42.3 |
| Ti | <0.01 |
| Cr | <0.07 |
| Mn | <0.07 |
| Fe | <0.04 |
| Co | <0.03 |
| Ni | <0.07 |
| Mo | 0.85 |

The neutralized solution is heated to 70 to 90° C. and filtered in a high-temperature state within the temperature range of 70 to 90° C. so as to obtain ammonium paratungstate pentahydrate crystals. In addition, the obtained crystals are calcined so as to form a tungsten oxide. The tungsten oxide is further subject to hydrogen reduction so as to obtain a high-purity tungsten powder having a phosphorus content of less than 1 wtppm. In addition, when performing neutralization with hydrochloric acid, the pH is desirably set to 4 or more and 6 or less so as to precipitate ammonium paratungstate. It is thereby possible to achieve a phosphorus content in the ammonium paratungstate of less than 0.7 wtppm, and in particular 0.4 wtppm or less, and even 0.2 wtppm or less. With respect to the phosphorus content in the ammonium paratungstate in the foregoing case, for instance, if the phosphorus content in the ammonium paratungstate is less than 0.7 wtppm, the content will be less than 1 wtppm in the tungsten (the same calculation is performed throughout this specification).

It goes without saying that the technology described in Patent Document 6 can be used other than the requirements of the production method of the present invention.

When processing the high-purity tungsten powder into a target, it may be sintered according to a heretofore known method. For example, a heretofore known method, in which pressure sintering is performed in vacuum after plasma treatment of applying high-frequency current to the tungsten powder under a vacuum and generating plasma between the tungsten powder surfaces, or pressure sintering is performed simultaneously with plasma treatment of applying high-frequency current to the tungsten powder under a vacuum and generating plasma between the tungsten powder surfaces, can be used (refer to Japanese Patent No. 3086447). Incidentally, this publically known art is a method that was developed by the present Applicant.

In particular, when the phosphorus content exceeds 0.7 wtppm, and even 1 wtppm, there will be an abnormal growth region where the grain size exceeds 500 μm, in the vicinity of the target surface. The area where this abnormal growth region occurs will be limited to the vicinity of the surface when the phosphorus content is less than 1.0 wtppm, but when the amount thereof increases and exceeds 1.0 wtppm, it gradually spreads to the inside of the tungsten target. Moreover, the frequency of abnormally grown crystals will also increase. This tendency becomes prominent as the phosphorus content increases.

Generally speaking, if the foregoing abnormally grown coarse grains exist, they can be eliminated by grinding the surface. However, if the abnormal growth region has spread internally, it is undeniable that the amount of grinding to be performed for eliminating the coarse grains will increase. This means that the product yield will significantly decrease. Moreover, the yield will decrease even further since the existence of coarse grains causes chipping during the machining process, and it will cause the production cost to increase.

Thus, although there is a method to limit the machining process and obtain a tungsten target in which the existence of abnormal grains having an average grain size exceeding 50 μm is connived; the existence of coarse grains causes the sputtering rate to become uneven, and also causes a new problem of deteriorating the uniformity of the deposited film.

Accordingly, it could be said that, preferably, the generation region of abnormal grains is kept in the area of layer within 1 mm from the surface. If the amount of phosphorus is reduced, the generation of abnormal grains Moreover, with the high-purity tungsten powder having a phosphorus content of less than 1.0 wtppm, in particular 0.7 wtppm or less, and even 0.4 wtppm or less, obtained by the manufacturing method of the present invention, it is preferable that the total impurity concentration is 10 wtppm or less, and the oxygen content and carbon content as gas components are respectively 50 wtppm or less. These are unavoidable impurities, but it is preferable to reduce any of these.

Accordingly, if the high-purity tungsten powder of the present invention having a phosphorus content of less than 1.0 wtppm, in particular 0.7 wtppm or less, and even 0.4 wtppm or less, is used, for example, to produce a sputtering target of sintered tungsten compact; the abnormal grain growth of crystals can be effectively inhibited.

Thus, it is thereby possible to prevent the deterioration in the target strength and resolve, at once, the numerous problems encountered in a sintered tungsten target; specifically, occurrence of defective targets, deterioration of yield in the target production process, increase in production costs, and so on.

Furthermore, as a result of sputtering a target that is manufactured using the high-purity tungsten powder of the present invention having a phosphorus content of less than 1.0 wtppm, in particular 0.7 wtppm or less and even 0.4 wtppm or less, a superior effect is yielded in that the uniformity of the tungsten wiring film can be improved.

In addition, with sputtering target obtained as described above, the density will improve, and it will reduce holes, and lead to refinement of the crystal grains, and uniformity and smoothing of the sputtered surface of the target. Thus, the present invention yields the effect of being able to reduce the generation of particles and nodules during the sputtering process and additionally extend the target life, and also yields the effect of being able to reduce the variation in quality and improve mass productivity.

EXAMPLES

The Examples and Comparative Examples of the present invention are now explained. These Examples are merely illustrative, and the present invention shall in no way be limited thereby. In other words, various modifications and other embodiments based on the technical spirit claimed in the claims shall be included in the present invention as a matter of course.

Example 1

100 g of ammonium paratungstate powder containing 2.0 wtppm of phosphorus as an impurity was reacted with 35% hydrochloric acid (HCl) at 70° C. so as to precipitate tungstate ($H_2WO_4$). Subsequently, this was washed with deionized water and dissolved in 70 ml of 29% ammonia water. In addition, deionized water was added thereto to achieve a constant volume of 370 ml.

This was neutralized with 35% hydrochloric acid at a normal temperature (20 to 40° C.) to adjust the pH at 4.46, and ammonium paratungstate undecahydrate crystals were precipitated. Subsequently, this solution was heated at 80° C. for 1 hour, and filtered in a high-temperature state by maintaining the foregoing temperature so as to obtain ammonium paratungstate pentahydrate crystals. The obtained crystals were further washed with deionized water and dried.

While the phosphorus content in the ammonium paratungstate undecahydrate crystals during the process was 2.0 wtppm, the phosphorus content in the ammonium paratungstate pentahydrate crystals was 0.1 wtppm. Moreover, the recovered ammonium paratungstate was 63.4 g. In other words, the recovery rate was 63.4%. In comparison to Example 2 and Comparative Examples 1 and 2 described later, it was acknowledged that the phosphorus content was lower when the pH was lower within the scope of the present invention.

In addition, this was calcined to form a tungsten oxide, and the tungsten oxide was subject to hydrogen reduction so that a high-purity tungsten powder having a phosphorus content of 0.1 wtppm could be obtained. The outline and results of the foregoing processes are compared with the other examples and shown in Table 2.

TABLE 2

| | Raw Material APT | | | Recovered APT | |
|---|---|---|---|---|---|
| | P Concentration (ppm) | Weight (g) | Neutralization pH | P Concentration (ppm) | Weight (g) |
| Example 1 | 2.0 | 100 | 4.46 | 0.1 | 63.4 |
| Example 2 | 2.0 | 100 | 5.43 | 0.2 | 73.3 |
| Example 3 | 2.0 | 100 | 6.75 | 0.5 | 83.4 |
| Comparative Example 1 | 2.0 | 100 | 4.83 | 2.1 | 76.7 |
| Comparative Example 2 | 2.0 | 100 | 5.05 | 1.2 | 79.8 |

APT: ammonium paratungstate

Example 2

Similarly, 100 g of ammonium paratungstate pentahydrate powder containing 2.0 wtppm of phosphorus as an impurity was reacted with 35% hydrochloric acid (HCl) at 70° C. so as to precipitate tungstate ($H_2WO_4$). Subsequently, this was washed with deionized water and dissolved in 70 ml of 29% ammonia water. In addition, deionized water was added thereto to achieve a constant volume of 370 ml.

This was neutralized with 35% hydrochloric acid at a normal temperature to adjust the pH at 5.43, and ammonium paratungstate undecahydrate crystals were precipitated. Subsequently, this solution was heated at 80° C. for 1 hour, and filtered in a high-temperature state by maintaining the foregoing temperature so as to obtain ammonium paratungstate pentahydrate crystals. The obtained crystals were further washed with deionized water and dried.

While the phosphorus content in the ammonium paratungstate undecahydrate crystals during the process was 2.0 wtppm, the phosphorus content in the ammonium paratungstate pentahydrate crystals was 0.2 wtppm. Moreover, the recovered ammonium paratungstate was 73.3 g. In other words, the recovery rate was 73.3%. Although the recovery rate will increase as the pH is increased, the phosphorus content also tends to increase.

In addition, this was calcined to form a tungsten oxide, and the tungsten oxide was subject to hydrogen reduction so that a high-purity tungsten powder having a phosphorus content of 0.3 wtppm could be obtained. The outline and results of the foregoing processes are compared with the other examples and shown in Table 2.

Example 3

Similarly, 100 g of ammonium paratungstate powder containing 2.0 wtppm of phosphorus as an impurity was reacted with 35% hydrochloric acid (HCl) at 70° C. so as to precipitate tungstate ($H_2WO_4$). Subsequently, this was washed with deionized water and dissolved in 70 ml of 29% ammonia water. In addition, this was made to be a constant volume of 370 ml with deionized water.

This was neutralized with 35% hydrochloric acid at a normal temperature to adjust the pH at 6.75, and ammonium paratungstate undecahydrate crystals were precipitated. Subsequently, this solution was heated at 80° C. for 1 hour, and filtered in a high-temperature state by maintaining the foregoing temperature so as to obtain ammonium paratungstate pentahydrate crystals.

While the phosphorus content in the ammonium paratungstate undecahydrate crystals during the process was 2.1 wtppm, the phosphorus content in the ammonium paratungstate pentahydrate crystals was 0.5 wtppm. Moreover, the recovered ammonium paratungstate was 83.4 g. In other words, the recovery rate was 83.4%. In this case, although the recovery rate will increase as the pH is increased, the phosphorus content also tends to increase.

In addition, this was calcined to form a tungsten oxide, and the tungsten oxide was subject to hydrogen reduction so that a high-purity tungsten powder having a phosphorus content of 0.7 wtppm could be obtained, but there was a slight problem in terms of the reduction of phosphorus. The outline and results of the foregoing processes are compared with the other examples and shown in Table 2.

Comparative Example 1

As with the Examples, 100 g of ammonium paratungstate powder containing 2.0 wtppm of phosphorus as an impurity was reacted with 35% hydrochloric acid (HCl) at 70° C. so as to precipitate tungstate ($H_2WO_4$). Subsequently, this was washed with deionized water and dissolved in 70 ml of 29% ammonia water. In addition, deionized water was added thereto to achieve a constant volume of 370 ml.

This was neutralized with 35% hydrochloric acid in a state of being heated to 60° C. to adjust the pH at 4.83, and ammonium paratungstate was precipitated. Subsequently, this solution was heated at 80° C. for 1 hour, and filtered in a high-temperature state by maintaining the foregoing temperature so as to obtain ammonium paratungstate crystals.

The phosphorus content in the ammonium paratungstate crystals was 2.1 wtppm. Moreover, the recovered ammonium paratungstate was 76.7 g. In other words, the recovery rate was 76.7%. When neutralization was performed at a high temperature, the phosphorus content increased and deviated from the object of the present invention. Note that, even when the pH was increased, the yield also deteriorated when compared with Examples. It can be understood the increase of the pH is not necessarily the best plan.

In addition, this was calcined to form a tungsten oxide, and the tungsten oxide was subject to hydrogen reduction so that a high-purity tungsten powder having a phosphorus content of 3.0 wtppm could be obtained, but there was a major problem in terms of the reduction of phosphorus. The outline and results of the foregoing processes are compared with the other examples and shown in Table 2.

Comparative Example 2

As with Example 1, 100 g of ammonium paratungstate powder containing 2.0 wtppm of phosphorus as an impurity was reacted with 35% hydrochloric acid (HCl) at 70° C. so as to precipitate tungstate ($H_2WO_4$). Subsequently, this was washed with deionized water and dissolved in 70 ml of 29% ammonia water. In addition, deionized water was added thereto to achieve a constant volume of 370 ml.

This was neutralized with 35% hydrochloric acid in a state of being heated to 70° C. using a hot stirrer to adjust the pH at 5.05, and ammonium paratungstate undecahydrate crystals were precipitated. Subsequently, this solution was heated at 80° C. for 17 hours, and filtered in a high-temperature state by maintaining the foregoing temperature so as to obtain ammonium paratungstate pentahydrate crystals.

The phosphorus content in the ammonium paratungstate crystals was 1.2 wtppm. Moreover, the recovered ammonium paratungstate was 79.8 g. In other words, the recovery rate was 79.8%. When neutralization was performed at condition of 70° C. or higher, the phosphorus content increased and deviated from the object of the present invention.

In addition, this was calcined to form a tungsten oxide, and the tungsten oxide was subject to hydrogen reduction so that a high-purity tungsten powder having a phosphorus content of 1.7 wtppm could be obtained, but there was a major problem in terms of the reduction of phosphorus. The outline and results of the foregoing processes are compared with the other examples and shown in Table 2.

INDUSTRIAL APPLICABILITY

As a result of reducing the phosphorus content in the high-purity tungsten powder to be less than 1 wtppm and preferably 0.5 wtppm or less, the abnormal grain growth of tungsten can be effectively inhibited. When this high-purity tungsten powder is used for manufacturing the target, superior effects are yielded in that it becomes possible to prevent the deterioration in the target strength and resolve, at once, the numerous problems encountered in a sintered tungsten target; specifically, occurrence of defective targets, deterioration of yield in the target production process, increase in production costs and so on. Also, a superior effect is yielded in that it becomes possible to improve the uniformity of the tungsten wiring film. The production method of the present invention can provide high-purity tungsten powder in which the phosphorus content is adjusted, respectively according to its usage, to be less than 1 wtppm, preferably 0.7 wtppm or less, more preferably 0.4 wtppm or less, and most preferably 0.2 wtppm or less; and the sputtering target manufactured by using this high-purity tungsten powder is extremely effective for use in producing a target material for an LSI wiring film.

The invention claimed is:

1. A method for producing a high-purity tungsten powder having a phosphorus content of less than 1 wtppm; wherein an ammonium tungstate solution is used as a starting material and neutralized with hydrochloric acid at a temperature of 50° C. or less to adjust the pH at 4 or more and less than 7 so as to precipitate ammonium paratungstate undecahydrate crystals, the resulting solution is heated to 70 to 90° C. and filtered while at a temperature of 70 to 90° C. so as to obtain ammonium paratungstate pentahydrate crystals, the obtained crystals are calcined so as to form a tungsten oxide, and the tungsten oxide is subject to hydrogen reduction so as to obtain a high-purity tungsten powder.

2. The method according to claim 1, wherein the ammonium tungstate solution used as the starting material has a content of phosphorus of 1 wtppm or more.

3. The method according to claim 1, wherein the ammonium tungstate solution used as the starting material contains phosphorus in an amount of 1 wtppm or more as a content assuming the phosphorus is in tungsten metal.

4. A method for producing a high-purity tungsten powder having a phosphorus content of 0.4 wtppm or less; wherein an ammonium tungstate solution is used as a starting material and neutralized with hydrochloric acid at a temperature of 50° C. or less to adjust the pH at 4 or more and 6 or less so as to precipitate ammonium paratungstate undecahydrate crystals, the resulting solution is heated to 70 to 90° C. and filtered while at a temperature of 70 to 90° C. so as to obtain ammonium paratungstate pentahydrate crystals, the obtained crystals are calcined so as to form a tungsten oxide, and the tungsten oxide is subject to hydrogen reduction so as to obtain a high-purity tungsten powder.

* * * * *

UNITED STATES PATENT AND TRADEMARK OFFICE

CERTIFICATE OF CORRECTION

PATENT NO. : 8,764,877 B2
APPLICATION NO. : 13/498252
DATED : July 1, 2014
INVENTOR(S) : Jin Sato et al.

It is certified that error appears in the above-identified patent and that said Letters Patent is hereby corrected as shown below:

In the Specification

Column 6, line 12 "grains" should read "grains having an average grain size exceeding 50 μm will decrease considerably."

Signed and Sealed this
Fourteenth Day of October, 2014

Michelle K. Lee

Michelle K. Lee
*Deputy Director of the United States Patent and Trademark Office*